US009692133B2

(12) United States Patent
Kakuya et al.

(10) Patent No.: US 9,692,133 B2
(45) Date of Patent: Jun. 27, 2017

(54) ANTENNA

(71) Applicants: DENSO CORPORATION, Kariya, Aichi-pref. (JP); NIPPON SOKEN, INC., Nishio, Aichi-pref. (JP)

(72) Inventors: Yuuji Kakuya, Okazaki (JP); Munenori Matsumoto, Kariya (JP); Akira Takaoka, Okazaki (JP); Toshifumi Shimoda, Anjo (JP); Takatoshi Sekizawa, Kariya (JP); Nobuya Watabe, Nagoya (JP)

(73) Assignees: DENSO CORPORATION, Kariya, Aichi-pref. (JP); NIPPON SOKEN, INC., Nishio, Aichi-pref. (JP)

( * ) Notice: Subject to any disclaimer, the term of this patent is extended or adjusted under 35 U.S.C. 154(b) by 47 days.

(21) Appl. No.: 14/436,124

(22) PCT Filed: Oct. 23, 2013

(86) PCT No.: PCT/JP2013/006255

§ 371 (c)(1),
(2) Date: Apr. 16, 2015

(87) PCT Pub. No.: WO2014/064927

PCT Pub. Date: May 1, 2014

(65) Prior Publication Data

US 2015/0270614 A1 Sep. 24, 2015

(30) Foreign Application Priority Data

Oct. 24, 2012 (JP) ..... 2012-234802
Oct. 16, 2013 (JP) ..... 2013-215644

(51) Int. Cl.
*H01Q 1/24* (2006.01)
*H01Q 9/06* (2006.01)
(Continued)

(52) U.S. Cl.
CPC ..... *H01Q 9/065* (2013.01); *H01Q 1/243* (2013.01); *H01Q 1/48* (2013.01); *H01Q 5/328* (2015.01);
(Continued)

(58) Field of Classification Search
CPC ..... H01Q 7/00; H01Q 9/065; H01Q 1/243; H01Q 1/48
(Continued)

(56) References Cited

U.S. PATENT DOCUMENTS 5,966,097 A * 10/1999 Fukasawa ..... H01Q 9/40 343/700 MS
2004/0041734 A1* 3/2004 Shiotsu ..... G06F 1/1616 343/702
(Continued)

FOREIGN PATENT DOCUMENTS

JP H0279602 A 3/1990
JP 2004-048471 A 2/2004
(Continued)

OTHER PUBLICATIONS

Office Action mailed Feb. 29, 2016 in the corresponding Korean Application No. 10-2015-7009237 with English translation.
(Continued)

*Primary Examiner* — Dieu H Duong
(74) *Attorney, Agent, or Firm* — Harness, Dickey & Pierce, P.L.C.

(57) ABSTRACT

In an antenna, a first element is connected to a GND of a feeder, on the same plane as a GND of a wireless circuit, and isolated from the GND of the wireless circuit. A second element is on the same plane as the GND of the wireless circuit and a first end connected to the first element and a second end as an open end. The third element has a first end connected to a power source of the feeder and located in a
(Continued)

region occupied by the first element perpendicularly to the first element so that its first end source faces down. The fourth element has a first end connected to a second end of the third element and a second end as an open end, is parallel to the first element, and is perpendicular to a line connecting the first and second ends of the second element.

10 Claims, 15 Drawing Sheets

(51) Int. Cl.

| | |
|---|---|
| ***H01Q 1/48*** | (2006.01) |
| ***H01Q 9/42*** | (2006.01) |
| ***H01Q 21/30*** | (2006.01) |
| ***H01Q 5/328*** | (2015.01) |
| ***H01Q 5/378*** | (2015.01) |
| ***H01Q 7/00*** | (2006.01) |

(52) U.S. Cl.
CPC ..... *H01Q 5/378* (2015.01); *H01Q 7/00* (2013.01); *H01Q 9/42* (2013.01); *H01Q 21/30* (2013.01)

(58) Field of Classification Search
USPC ..... 343/700 MS, 702
See application file for complete search history.

(56) References Cited

U.S. PATENT DOCUMENTS

| | | | | |
|---|---|---|---|---|
| 2007/0057854 | A1 | 3/2007 | Oodachi et al. | |
| 2009/0273535 | A1* | 11/2009 | Lee | H01Q 1/243 343/848 |
| 2011/0140981 | A1* | 6/2011 | Yukimoto | H01Q 1/3241 343/848 |
| 2012/0313824 | A1 | 12/2012 | Watanabe et al. | |

FOREIGN PATENT DOCUMENTS

| | | | |
|---|---|---|---|
| JP | 2004064312 | A | 2/2004 |
| JP | 2005-217623 | A | 8/2005 |
| JP | 2007081712 | A | 3/2007 |
| JP | 2007124181 | A | 5/2007 |
| JP | 2008-141661 | A | 6/2008 |
| KR | 2006-0035999 | A | 4/2006 |
| WO | WO-2012070242 | A1 | 5/2012 |

OTHER PUBLICATIONS

International Search Report and Written Opinion (in Japanese with English Translation) for PCT/JP2013/006255, mailed Jan. 14, 2014; ISA/JP.

* cited by examiner

FIG. 8A
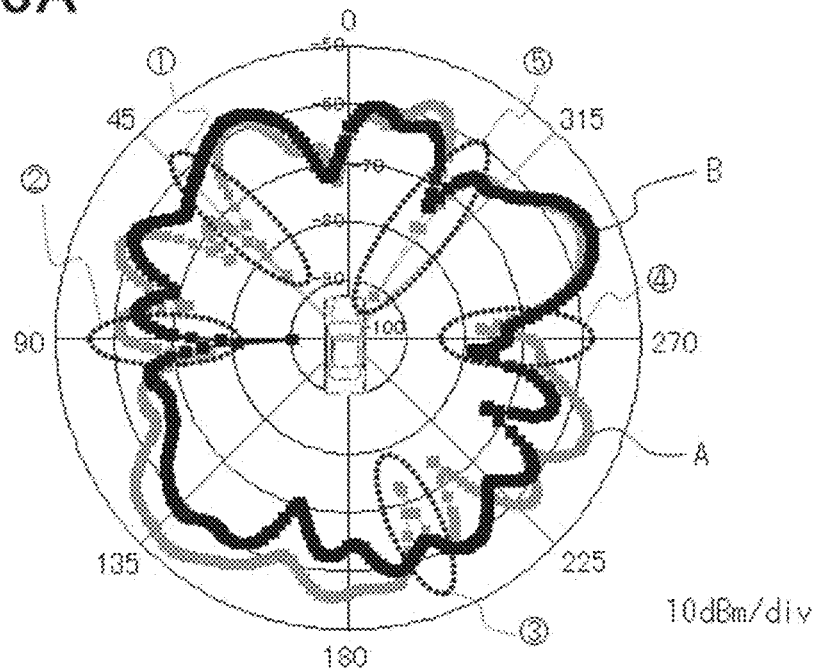
FIG. 8B
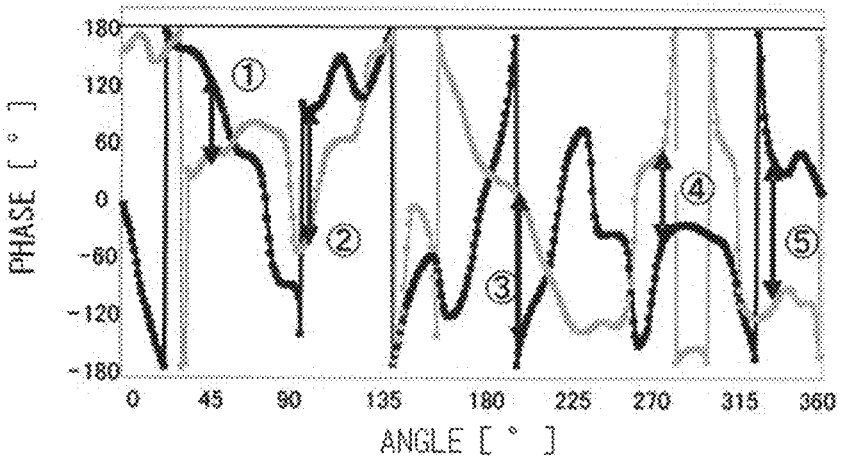
FIG. 8C
| NUMBER | ① | ② | ③ | ④ | ⑤ |
|---|---|---|---|---|---|
| PHASE DIFFERENCE | 82° | 119° | 110° | 71° | 103° |

ANTENNA

CROSS REFERENCE TO RELATED APPLICATIONS

This application is a U.S. National Phase Application under 35 U.S.C. 371 of International Application No. PCT/JP2013/006255 filed on Oct. 23, 2013 and published in Japanese as WO 2014/064927 A1 on May 1, 2014. This disclosure is based on and claims the benefit of priority from Japanese Patent Applications No. 2012-234802 filed on Oct. 24, 2012 and No. 2013-215644 filed on Oct. 16, 2013. The entire disclosures of all of the above applications are incorporated herein by reference.

TECHNICAL FIELD

The present disclosure relates to an antenna capable of reducing noise and improving radiation characteristics.

BACKGROUND ART

In the field of card-type mobile wireless antenna having a feeding point, a matching circuit, and a λ/4-antenna element mounted on a board with a wireless circuit and used by being inserted into a terminal device such as a personal computer or a PDA, an antenna has been conventionally proposed that includes a grounding conductor having a first end open-ended near the λ/4-antenna element and a second end grounded at GND so that a casing current can be reduced (refer to, for example, a patent literature 1).

According to this type of antenna, since a λ/2 current distribution can be formed without a circuit GND where a noise source exists, a dipole antenna can be constructed with a portion of the circuit GND so as to reduce the effect of noise.

There are various types of vehicle-mounted antennas including a keyless entry system in which a receiver is generally installed in a vehicle compartment. An electric field antenna such as a dipole or monopole is used as a receiving antenna.

However, in a vehicle compartment, a standing wave is formed by multipath incoming wave so that electric field can have peaks and troughs. Therefore, if the receiving antenna is located at a position corresponding to the trough of the electric field, what is called a Null state occurs, and communication performance is seriously deteriorated.

Although a space diversity or polarization diversity is generally used as a method to improve such a Null state, a receiver increases in size in either method.

A radio wave has a characteristic that when a standing wave of an electric magnetic field is at a trough, a standing wave of a magnetic field is at a peak. According to this characteristic, when the electric field and the magnetic field are separately received, the electric field and the magnetic field can compensate each other for Null. Further, since the electric field and the magnetic field come in combination with each other, there is no need to separate their antennas from each other. Accordingly, a receiver is expected to decrease in size.

In the prior art, however, since an electric field antenna and a magnetic field antenna are provided on the same GND, it is difficult to maintain isolation between the antennas. If the isolation between the electric field antenna and the magnetic field antenna is not maintained, the electric field antenna and the magnetic field antenna have the same directivity, so that the expected compensation effect cannot be achieved.

Ultimately, therefore, isolation is maintained by spatially separating the antennas from each other or by adding a circuit (e.g., balance/unbalance conversion circuit) to maintain isolation (refer to, for example, a patent literature 2).

PRIOR ART LITERATURES

Patent Literature

Patent Literature 1: JP 2004-64312A
Patent Literature 2: JP 2007-124182A

SUMMARY OF INVENTION

However, in the conventional antenna described above, since one end of the antenna element is connected to the circuit GND serving as a noise source, circuit GND noise superimposes on the antenna element. If the antenna element is perfectly disconnected from the circuit GND to avoid this, it operates as a dipole antenna. As a result, a radio wave coming from some directions cannot be received.

Further, in a case where a GND of the electric field antenna and a GND of the magnetic field antenna are separated using a balance/unbalance conversion circuit, the balance/unbalance conversion circuit is required. Since the antennas cannot be arranged close to each other accordingly, there is a limit to a reduction in side. Further, the use of the balance/unbalance conversion circuit results in an increase in cost.

In view of the above, it is an object of the present disclosure to provide an antenna capable of reducing nose and improving radiation characteristics.

According to a first aspect of the present disclosure, an antenna includes a feeder, a first element, a second element, a third element, and a fourth element.

The feeder includes a GND and a power source. The first element is connected to the GND of the feeder and has a predetermined area. The first element is on the same plane as a GND of a wireless circuit and electrically isolated from the GND of the wireless circuit.

A first end of the second element is connected to the first element, and a second end of the second element is open. The second element is on the same plane as the GND of the wireless circuit and has a predetermined electrical length.

A first end of the third element is connected to the power source of the feeder. The third element is located in a region occupied by the first element and substantially perpendicular to the first element in such a manner that the first end connected to the power source faces down. The third element has a predetermined height.

A first end of the fourth element is connected to a second end of the third element, and a second end of the fourth element is open. The fourth element is substantially parallel to the first element and substantially perpendicular to a line connecting the first end of the second element connected to the first element to the second end of the second element.

Since the antenna is constructed with the first to fourth elements as described above, the antenna is spatially and electrically isolated from the GND of the wireless circuit. Thus, the antenna serves as a balanced dipole structure from a perspective of noise superimposed from the GND of the wireless circuit.

Since noise of the GND of the wireless circuit is not superimposed on the antenna 1, noise reduction can be achieved.

Further, the antenna serves as a monopole antenna from a perspective of radio waves to be transmitted and received while serving as a balanced dipole antenna from a perspective of noise. Thus, the radiation characteristics can be improved.

Further, when the area of the first element is equal to or greater than an area of a circle whose radius is equal to a height of the third element, a gain of the antenna can be maximized.

Further, when a sum of electrical lengths of the second element, the third element, and the fourth element is equal to ½ of a wavelength of the radio wave to be transmitted and received, the gain of the antenna can be maximized.

The antenna can further include a fifth element having a first end connected to the fourth embodiment and a second end connected through a capacitor to the first element. Thus, directional characteristics of the antenna depend on a capacitance of the capacitor.

When the capacitor is a variable capacitor, the directional characteristics of the antenna can be changed easily.

The antenna can further include a parasitic loop antenna electrically isolated from the GND and the first to fourth elements. The parasitic loop antenna is placed close to and faces a side of at least one of the first to fourth elements to form a loop through a capacitor.

In such an approach, an electric field antenna (antenna constructed with the GND and the first to fourth elements) can be isolated from a GND of a magnetic field antenna (parasitic loop antenna) without using a balance/unbalance conversion circuit so that mutual interference through the GND can be prevented.

The "placed close to and faces a side of at least one of the first to fourth elements" means that it is placed within a distance which allows the magnetic fluxes of the magnetic fields of each element of the electric field antenna constructed with the GND and the first to fourth elements and the loop antenna to cross each other.

BRIEF DESCRIPTION OF THE DRAWINGS

The above and other objects, features and advantages of the present disclosure will become more apparent from the following detailed description made with reference to the accompanying drawings. In the drawings:

FIG. 8A is a diagram illustrating characteristics of the antenna according to the fourth embodiment;

FIG. 8B is a diagram illustrating the characteristics of the antenna according to the fourth embodiment;

FIG. 8C is a diagram illustrating the characteristics of the antenna according to the fourth embodiment;

EMBODIMENTS FOR CARRYING OUT INVENTION

Below, embodiments of the present disclosure are described with reference to the drawings. Throughout the embodiments, GND indicates a ground. The present disclosure is not limited to the embodiments, but can include various modifications inside the technical scope of the present disclosure.

(First Embodiment)

(Structure of Antenna 1)

Figure 1:
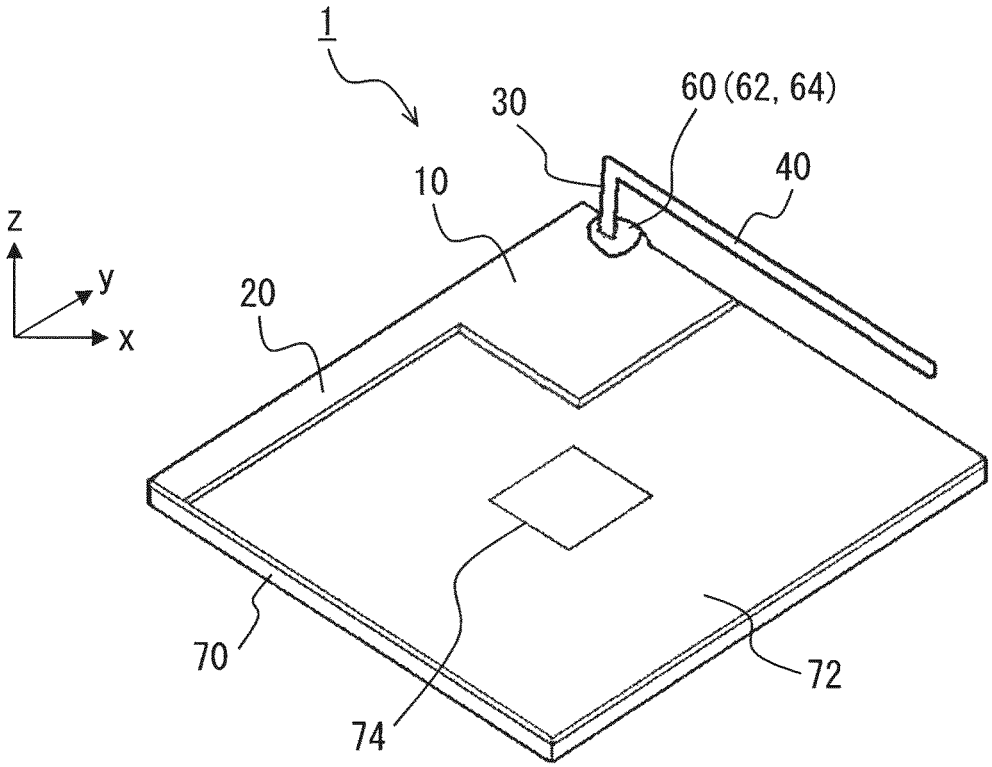
FIG. 1 is a diagram illustrating a simplified structure of an antenna according to a first embodiment.

FIG. 1 is a diagram illustrating a simplified structure of an antenna 1 according to the present disclosure. As shown in FIG. 1, the antenna 1 includes a feeder 60, a first element 10, a second element 20, a third element 30, and a fourth element 40, and these are placed on a board 70.

The feeder 60 is an input/output section for a radio wave to be transmitted and received by the antenna 1 and includes a GND 62 and a power source 64. The transmitting and receiving radio wave is inputted and outputted by inputting the transmitting radio wave from a wireless circuit to between the GND 62 and the power source 64 and by outputting the receiving radio wave from between the GND 62 and the power source 64 to the wireless circuit.

The first element 10 is an antenna element and shaped like a square, flat plate. The first element 10 is connected to the GND 62 of the feeder 60 and placed on the same plane as a GND 72 of the wireless circuit connected to the antenna 1. The first element 10 is electrically isolated from the GND 72 of the wireless circuit.

Although the first element 10 shown in FIG. 1 is square, it is not limited to a squire as long as an area of the first element is equal to or greater than an area of a circle whose radius is equal to a height of the third element. The shape of the first element 10 can be changed according to various types of board-manufacturing conditions and constraints and can be, for example, circular instead of square.

The second element 20 is an antenna element shaped like a square, flat plate with short and long sides and located on the same plane as the GND 72 of the wireless circuit. Further, one end (one of the short sides) of the second element 20 is connected to the first element 10, and the other end (the other of the short sides) of the second element 20 is open.

The third element 30 is an antenna element shaped like a bar. A first end of the third element 30 is connected to the power source 64 of the feeder 60. The third element 30 is located in a region occupied by the first element 10 and substantially perpendicular to the first element 10 in such a manner that the first end connected to the power source 64 faces down (first element side).

The fourth element 40 is an antenna element shaped like a bar. A first end of the fourth element 40 is connected to a second end (upper end) of the third element 30, and a second end of the fourth element 40 is open. The fourth element 40 is substantially parallel to the first element 10 and substantially perpendicular to a line connecting the first end of the second element 20 connected to the first element 10 to the second end of the second element 20.

A sum of an electrical length of the long side of the second element, an electrical length of the third element in its height direction, and an electrical length of the fourth element in its longitudinal direction is equal to ½ of a wavelength of a radio wave to be transmitted and received by the antenna 1.

Further, the GND 72 of the wireless circuit the board 70 has is shaped like a flat plate. The GND 72 of the wireless circuit is electrically isolated from the first element 10 and the second element 20 by a gap formed between the GND 72 of the wireless circuit and the first element 10 and the second element 20.

Further, an IC 74 is placed on the GND 72 of the wireless circuit of the board 70 and acts as a conductive noise source.

(Features of Antenna 1)

Figure 2A:
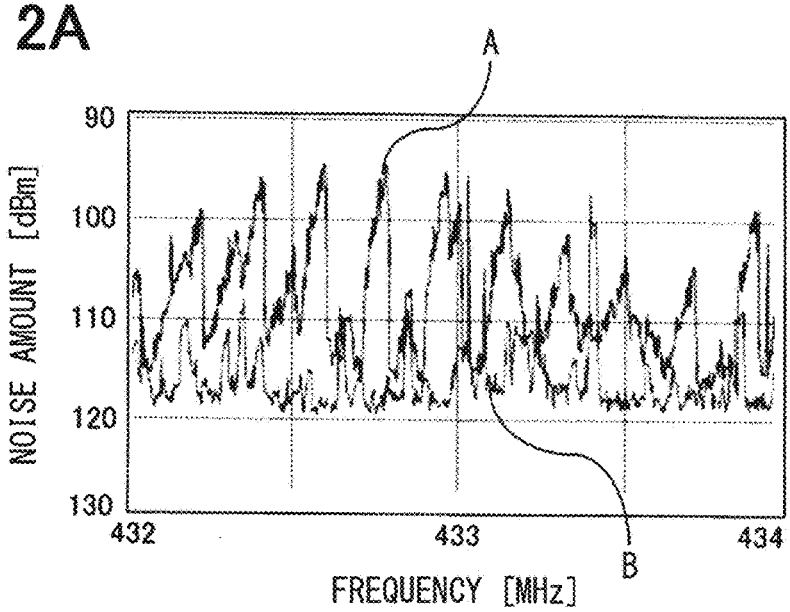
FIG. 2A is a diagram for explaining an effect of the antenna according to the first embodiment.
Figure 2B:
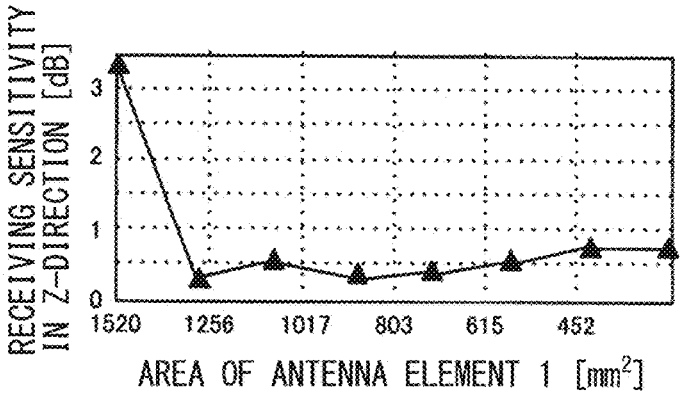
FIG. 2B is a diagram for explaining the effect of the antenna according to the first embodiment.
Figure 2C:
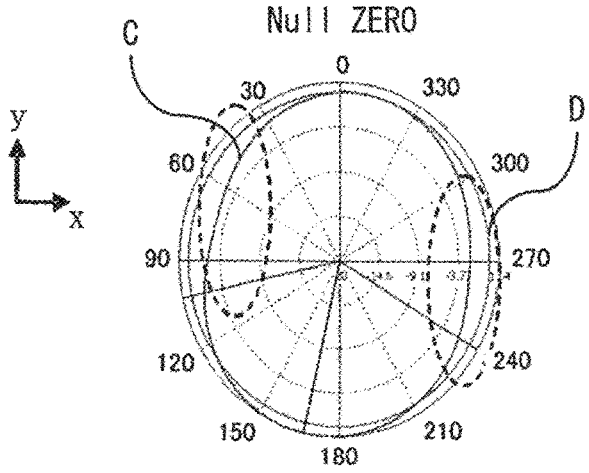
FIG. 2C is a diagram for explaining the effect of the antenna according to the first embodiment.

Next, an effect of the antenna 1 is described with reference to FIGS. 2A-C. FIGS. 2A-C show performances of a conventional antenna and the antenna 1 observed when the IC 74 (refer to FIG. 1) produces noise with a frequency of about 433.9 [MHz].

In FIG. 2A, the horizontal axis represents a frequency, and a vertical axis represents a noise level. A graph indicated by "A" represents noise in the conventional antenna, and a graph indicated by "B" represents noise in the antenna 1.

As shown in FIG. 2A, conductive noise superimposed from the IC 74 as the noise source is smaller in the antenna 1 than in the conventional antenna.

A reason for this is that since the antenna 1 serves a balanced dipole structure constructed with the first element 10 to the fourth element 40, the antenna 1 is spatially and electrically isolated from the GND of the wireless circuit.

Further, as shown in FIG. 2B, when the area of the first element 10 is 1256 [$mm^2$], i.e., when the area of the first element 10 is equal to or greater than an area whose radius is equal to 20 [mm] which is an electrical length of the second element 20, a strong electric field is formed in a Z-axis direction.

A reason for this is that since the first element 10 has a predetermined area, a capacitive coupling occurs between the first element 10 and the fourth element 40 so that the strong electric field can be formed in the Z-axis direction.

As a result, as indicated by "C" in FIG. 2C, in the conventional antenna, an electric field is not formed in three axis directions (X, Y, Z directions), so that there occurs a blind direction. On the other hand, in the antenna 1, as indicated by "D" in FIG. 2C, the electric field is formed in the three axis directions, so that the blind direction can be improved.

That is, the antenna 1 serves as an unbalanced antenna like a monopole antenna to improve radiation characteristics while serving as a balanced antenna to reduce nose superposition from a perspective of the noise source (IC74).

Further, since the area of the first element 10 is equal to or greater than the area of a circle whose radius is equal to the height of the third element 30, a gain of the antenna 1 is maximized.

Furthermore, since the sum of the electrical lengths of the second element 20, the third element 30, and the fourth element 40 is equal to ½ of the wavelength of the radio wave to be transmitted and received, the gain of the antenna 1 is maximized.

(Second Embodiment)

(Structure of Antenna 2)

Next, a structure of an antenna 2 according to a second embodiment is described with reference to FIG. 3. The antenna 2 corresponds to an addition of a fifth element 50 to the antenna 1 of the first embodiment.

Figure 3:
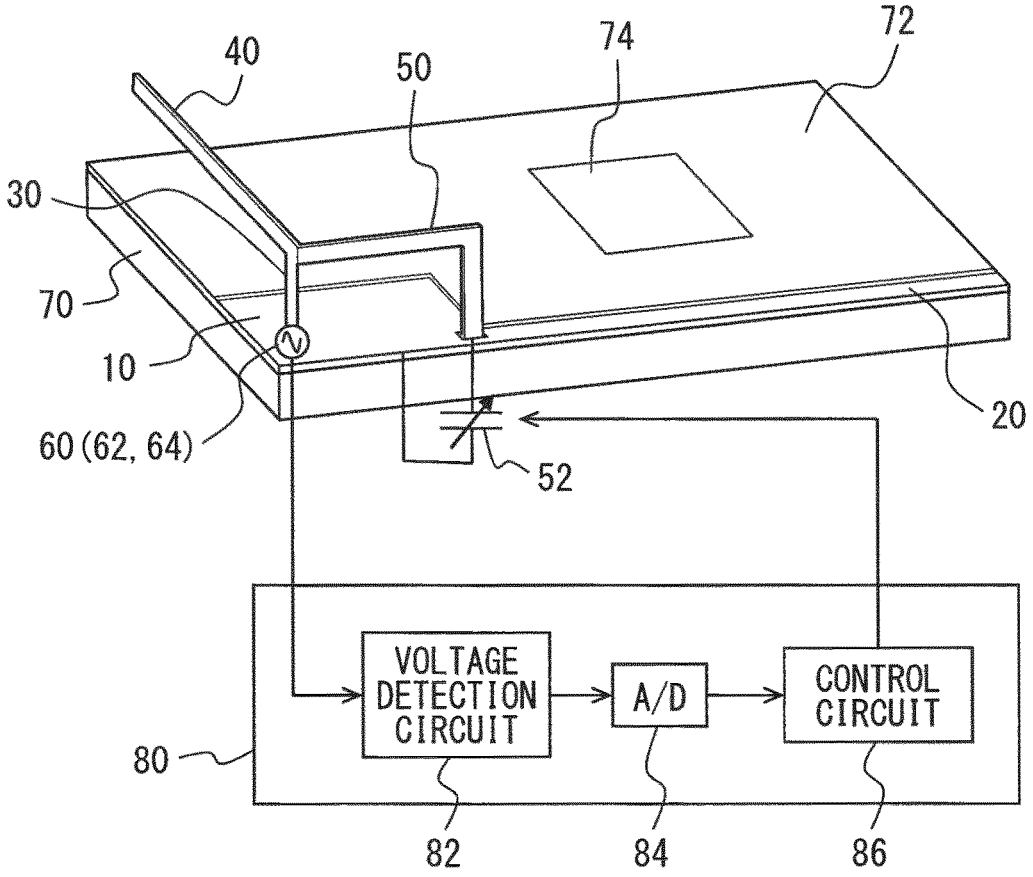
FIG. 3 is a diagram illustrating a simplified structure of an antenna according to a second embodiment.

As shown in FIG. 3, the antenna 2 includes the fifth element 50 in addition to the first element 10 to the fourth element 40 of the antenna 1 of the first embodiment.

The fifth element 50 is a L-shaped antenna element. An end of a long side of the fifth element 50 is connected to the fourth element 40, and an end of a short side of the fifth element 50 is connected to the first element 10 through a variable capacitor 52.

(Features of Antenna 2)

According to the antenna 2 having the above structure, directional characteristics of the antenna 2 depend on a capacitance of the variable capacitor 52.

Figure 4A:
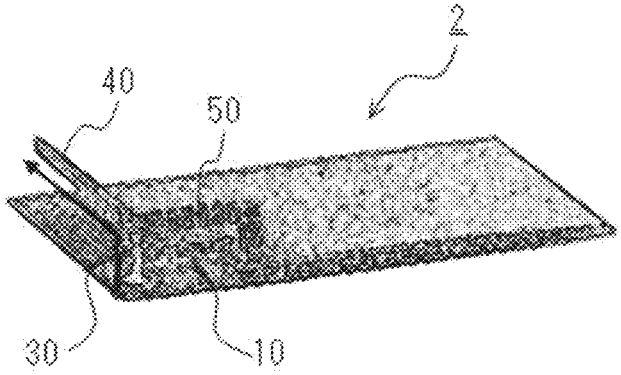
FIG. 4A is a diagram for explaining an effect of the antenna according to the second embodiment.

That is, when the antenna 2 has a transmitting and receiving frequency of 433 [MHz], and the variable capacitor 52 has a capacitance of 1 [pF], isolation of 368 [Ω] can be provided between the first element 10 and the fifth element 50 as shown in FIG. 4A. As indicated by an arrow in FIG. 4A, an electric current in the antenna 2 shown in FIG. 4A becomes concentrated at the third element 30 and the fourth element 40.

Figure 4B:
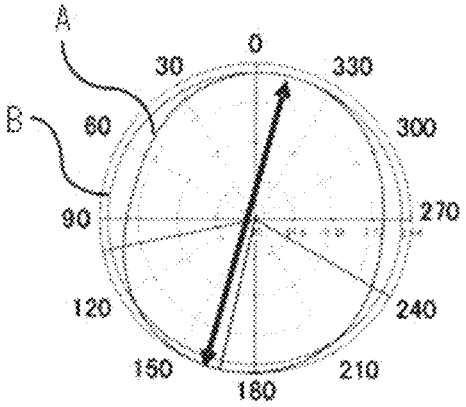
FIG. 4B is a diagram for explaining the effect of the antenna according to the second embodiment.

Thus, the antenna 2 operates as a dipole antenna and provides the same effects (noise reduction, radiation characteristics) as the antenna 1 of the first embodiment as shown in FIG. 4B (In FIG. 4B, "A" represents radiation characteristics of the conventional antenna, and "B" represents radiation characteristics of the antenna 2).

Figure 4C:
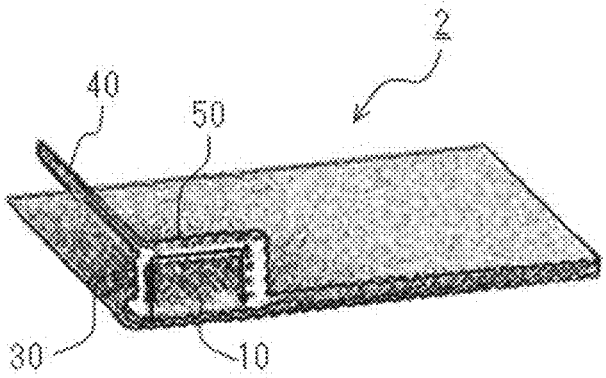
FIG. 4C is a diagram for explaining the effect of the antenna according to the second embodiment.

On the other hand, when the variable capacitor 52 has a capacitance of 50 [pF], the first element 10 and the first element 50 enter a substantially conducting state (7[Ω]), so that a current in the antenna 2 becomes concentrated at the fifth element 50 as indicated by an arrow in FIG. 4C. That is, a current distribution similar to that observed when a loop antenna is formed in part of a dipole antenna is generated.

Figure 4D:
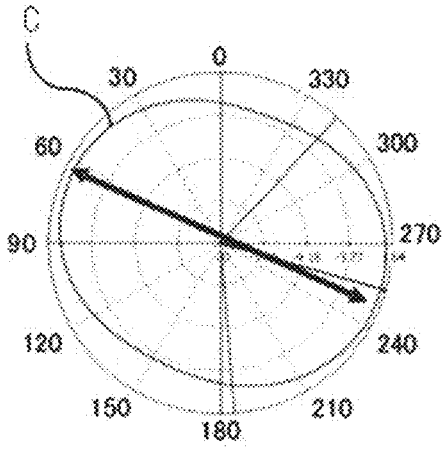
FIG. 4D is a diagram for explaining the effect of the antenna according to the second embodiment.

That is, as indicated by "C" in FIG. 4D, a direction in which the antenna 2 mainly radiates radio waves can be changed by changing the capacitance of the variable capacitor 52.

As shown in FIG. 3, the capacitance of the variable capacitor 52 can be controlled dynamically by an electronic circuit 80 so that the radiation characteristics can remain optimal. In this case, for example, a receiving voltage of the antenna 2 is monitored by a voltage detection circuit 82 and converted to a digital value by an A/D converter 84, and a control circuit 86 changes the capacitance of the variable capacitor 52 to a value which maximizes the receiving voltage.

(Third Embodiment)

(Structures of Antennas 3 and 4)

Figure 5A:
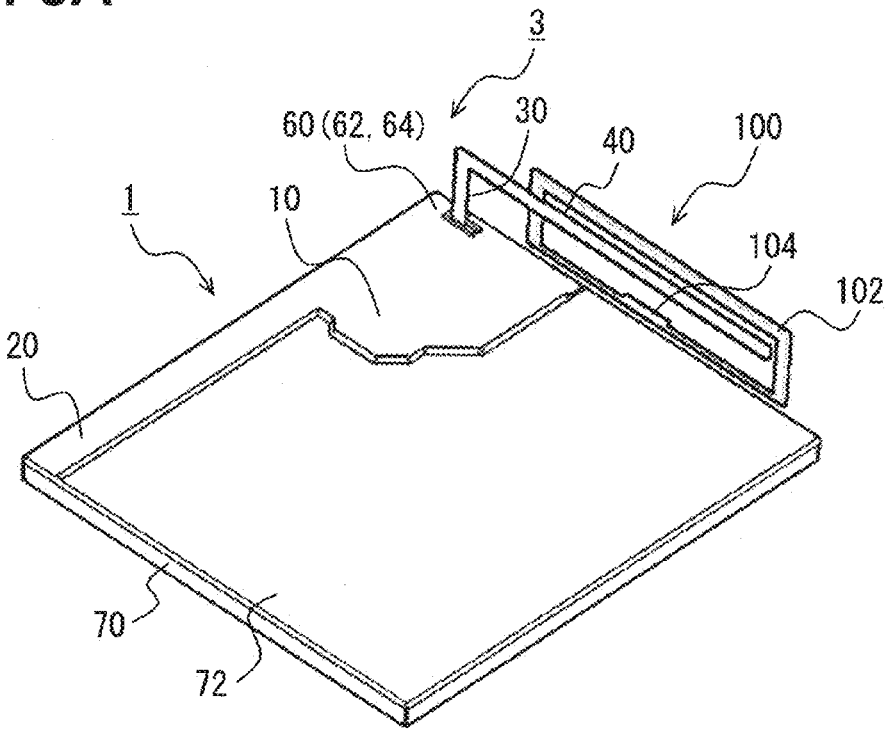
FIG. 5A is a diagram illustrating a simplified structure of an antenna according to a third embodiment.
Figure 5B:
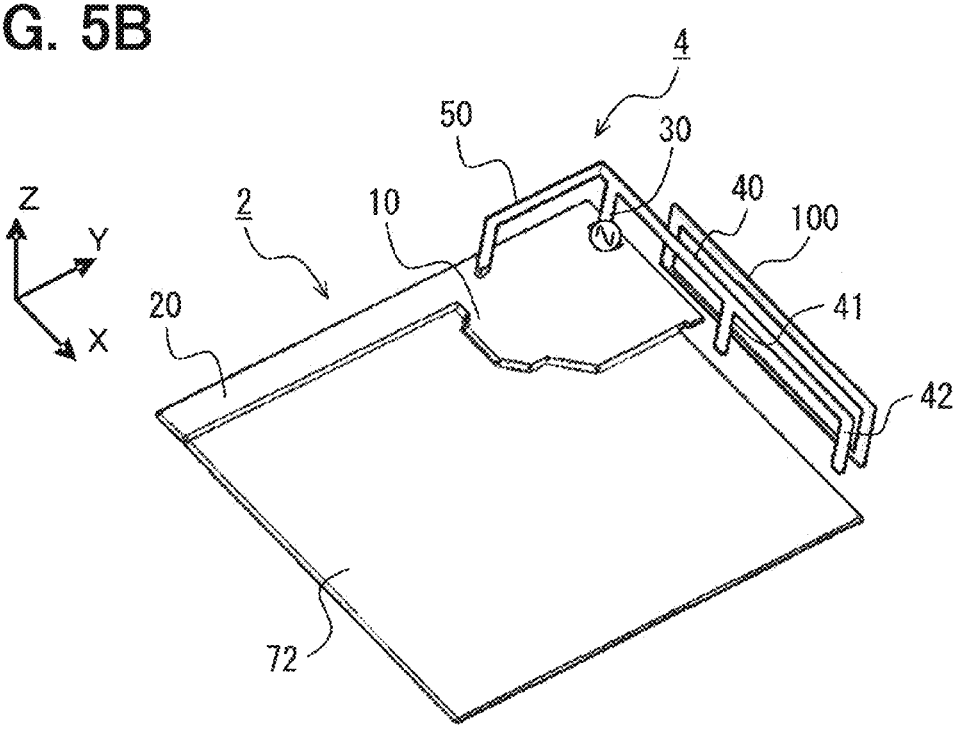
FIG. 5B is a diagram illustrating a simplified structure of an antenna according to the third embodiment.

Next, structures of antennas 3 and 4 according to a third embodiment are described with reference to FIGS. 5A and 5B. FIGS. 5A and 5B illustrate simplified structures of the antennas 3 and 4 according to the third embodiment.

As shown in FIG. 5A, the antenna 3 includes a loop antenna 100 in addition to the antenna 1 of the first embodiment.

The loop antenna 100 includes a loop element 102 and a capacitor 104.

The loop element 102 is a rectangular conductor, and a center portion of its one side (bottom side) in a longitudinal direction is cut off to provide a space where the capacitor 104 is connected in series.

The loop antenna 100 is placed close to the fourth element 40 so that its length direction can be the same as a direction of the fourth element 40.

The loop antenna 100 can be placed close to and parallel to surfaces of the first element 10 and the second element 20 besides the fourth element 40 and also can be place close to so that the length direction or width direction of the loop antenna 100 can be the same as a direction of the third element 30.

The meaning of the phrase "placed close to" is that it is placed within a distance which allows the magnetic fluxes of the magnetic fields of the first element 10 to the fourth element 40 of the antenna 1 and the loop antenna 100 to cross each other.

Further, as shown in FIG. 5B, the antenna 4 includes a loop antenna 100 in addition to an electric field antenna which is based on the antenna 2 of the second embodiment.

In the antenna 4, an element 41 and an element 42 extend from a center portion and a tip portion of the fourth element 40 of the antenna 2 in a direction toward the board 70 (in a perpendicular direction like the third element 30).

The loop antenna 100 is the same as the loop antenna 100 of the antenna 3 and placed in the same position as that of the antenna 3.

The "placed close to and faces a side of at least one of the first to fourth elements" means that it is placed within a distance which allows the magnetic fluxes of the magnetic fields of each element of the electric field antenna constructed with the GND and the first to fourth elements 10 to 40 and a parasitic antenna (100) to cross each other.

(Features of Antenna 3)

Next, features of the antenna 3 and the antenna 4 having the above structures are described. In the antennas 3 and 4, each of the antennas 1 and 2 is what is called an electric field antenna, and the loop antenna 100 is what is called a magnetic field antenna.

When the antennas 3 and 4 as electric field antennas are brought close to the loop antenna 100 as a magnetic field antenna as shown in FIGS. 5A and 5B, the antennas 3 and 4 as electric field antennas and the loop antenna 100 as a magnetic field antenna compensate each other for Null in their directivity.

In such an approach, an electric field antenna (antennas 1 and 2 constructed with the GND and the first to fourth elements) can be isolated from a GND of a magnetic field antenna (parasitic loop antenna (100)) without using a balance/unbalance conversion circuit so that mutual interference through the GND can be prevented.

Figure 6A:
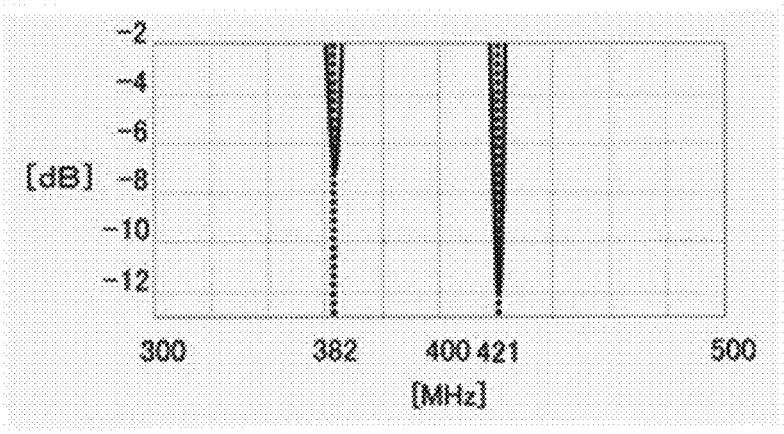
FIG. 6A is a diagram illustrating characteristics of an antenna according to the third embodiment.
Figure 6B:
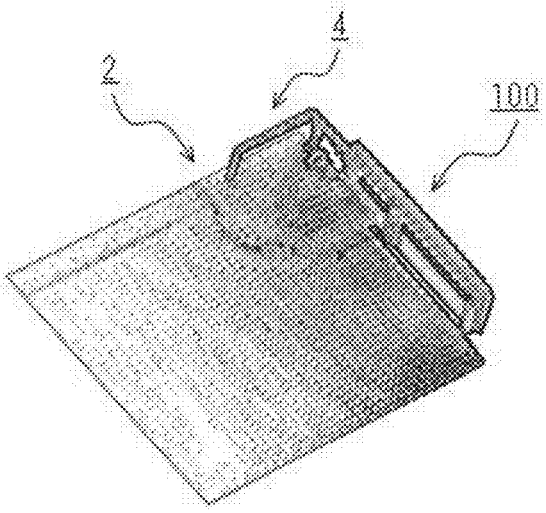
FIG. 6B is a diagram illustrating the characteristics of the antenna according to the third embodiment.
Figure 6C:
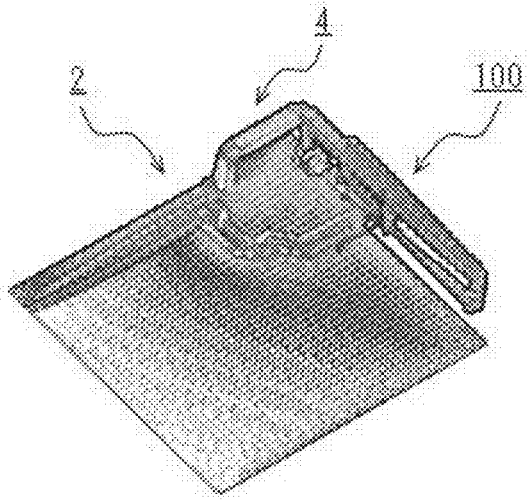
FIG. 6C is a diagram illustrating the characteristics of the antenna according to the third embodiment.

A specific example of these features is shown in FIGS. 6A-C. FIGS. 6A-C shows characteristics of the antenna 4. In the antenna 4, an inductor component of the fourth element 40 is magnetically coupled to the loop antenna 100 so that two resonances can occur as shown in FIG. 6A.

Out of two resonance points, one (at a frequency of 421 [MHz] in FIG. 6A) is a resonance point caused by the antenna 2 (electric field antenna), and the other (at a frequency of 382 [MHz] in FIG. 6A) is a resonance caused by the loop antenna 100 (magnetic field antenna).

Further, as shown in FIG. 6C, at the frequency of 421 [MHz], a large current distribution is observed in the antenna 2, and as shown in FIG. 6B, at the frequency of 382 [MHz], a large current distribution is observed in the loop antenna 100. Thus, resonation occurs, i.e., good transmission and reception can be achieved at the respective frequencies.

(Fourth Embodiment)

Figure 7A:
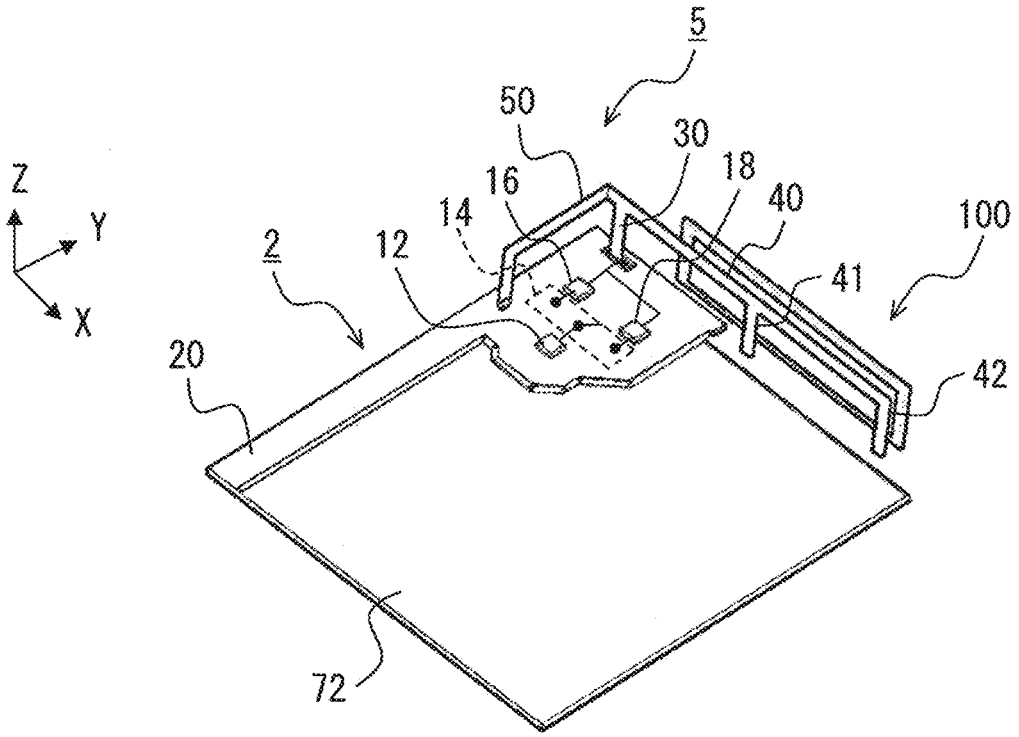
FIG. 7A is a diagram illustrating a simplified structure of an antenna according to a fourth embodiment.
Figure 7B:
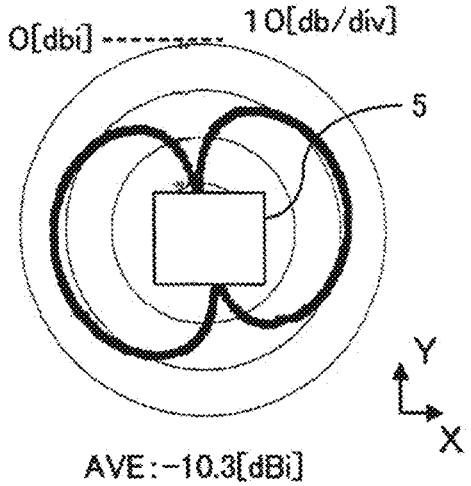
FIG. 7B is a diagram illustrating a directivity of the antenna according to the fourth embodiment.
Figure 7C:
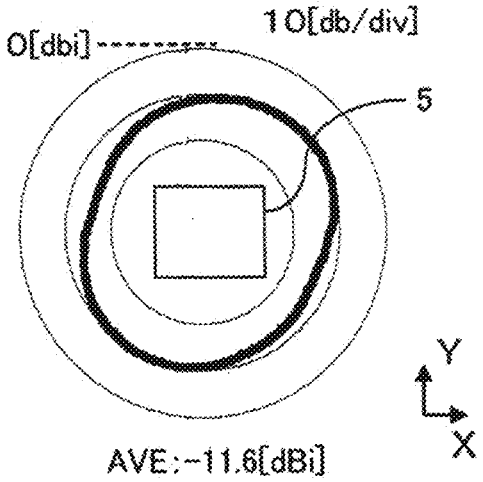
FIG. 7C is a diagram illustrating the directivity of the antenna according to the fourth embodiment.

Next, an antenna 5 which is configured so that the antenna 2 as an electric field antenna and the loop antenna 100 as a magnetic field antenna of the antenna 4 of the third embodiment can be switched between each other is described with reference to FIGS. 7A-C. FIGS. 7A-C illustrate a simplified structure and directivity of the antenna 5 according to the fourth embodiment.

As shown in FIG. 7A, the antenna 5 is configured such that a receiving circuit 12, a switch 14, a first matching circuit 16, and a second matching circuit 18 are provided in the first element 10 of the antenna 4 of the third embodiment.

The receiving circuit 12 is a circuit for receiving radio waves received by the antenna 2 as an electric field antenna and the loop antenna 100 as a magnetic field antenna of the antenna 4.

The switch 14 is a high-frequency switch and provided between the receiving circuit 12 and each of the first matching circuit 16 and the second matching circuit 18. The switch 14 selectively connects at least one of the first matching circuit 16 (i.e., antenna 2) and the second matching circuit 18 (i.e., loop antenna 100) to the receiving circuit 12 in accordance with a signal from the control circuit 86 (refer to FIG. 3).

The first matching circuit 16 is a high-frequent circuit for electrical matching, for example, to prevent high-frequency reflection from occurring between the antenna 2 and the receiving circuit 12 when the antenna 2 is connected through the switch 14 to the receiving circuit 12.

The second matching circuit 18 is a high-frequent circuit for electrical matching, for example, to prevent high-frequency reflection from occurring between the loop antenna 100 and the receiving circuit 12 when the loop antenna 100 is connected through the switch 14 to the receiving circuit 12.

(Features of Antenna 5)

In the antenna 5 having the above structure, at least one of the antenna 4 and the loop antenna 100 is selected by the signal from the control circuit 86. That is, the electric field antenna (antenna 2) and the magnetic field antenna (loop antenna 100) can operate at a predetermined frequency by adequately selecting the first matching circuit 16 and the second matching circuit 18.

FIGS. 7B and 7C show planar directivities observed when the antenna 5 operates at a frequency of 433 [MHz]. FIG. 7B shows a directivity of the loop antenna 100 alone, i.e., directivity observed when the antenna 5 operates as a magnetic field antenna. FIG. 7C shows a directivity of the antenna 2 alone, i.e., directivity observed when the antenna 5 operates as an electric field antenna.

Further, FIGS. 8A-C show directivities observed when the antenna 5 operates at a frequency of 433 [MHz]. In FIG. 8A, the center of the drawing is a position of a vehicle where the antenna 5 is mounted, and numbers around a circular graph represent a phase ranging from 0 to 360 degrees when a position directly in front of the vehicle is defined as 0 degree.

Further, a light solid line (indicated by "A" in FIG. 8A) represents the directivity of the antenna 5 observed when the loop antenna 100 is not operated (i.e., when the second matching circuit 18 is not selected by the switch 14), and a dark solid line (indicated by "B" in FIG. 8A) represents the directivity of the antenna 5 observed when the loop antenna 100 is operated (i.e., when both the first matching circuit 16 and the second matching circuit 18 are selected by the switch 14). FIG. 8B shows a phase difference at a Null point corresponding to that in FIG. 8A.

FIG. 8C shows a value of the phase difference for a number enclosed by a circle in FIGS. 8A and 8B.

As shown in FIGS. 8A and 8B, the Null caused in the electric field antenna (antenna 2) is compensated by the directivity of the magnetic field antenna (loop antenna 100). Further, since phases are displaced by 90 degree at this time, both an electric field and a magnetic field can be received.

(Fifth Embodiment)

Figure 9A:
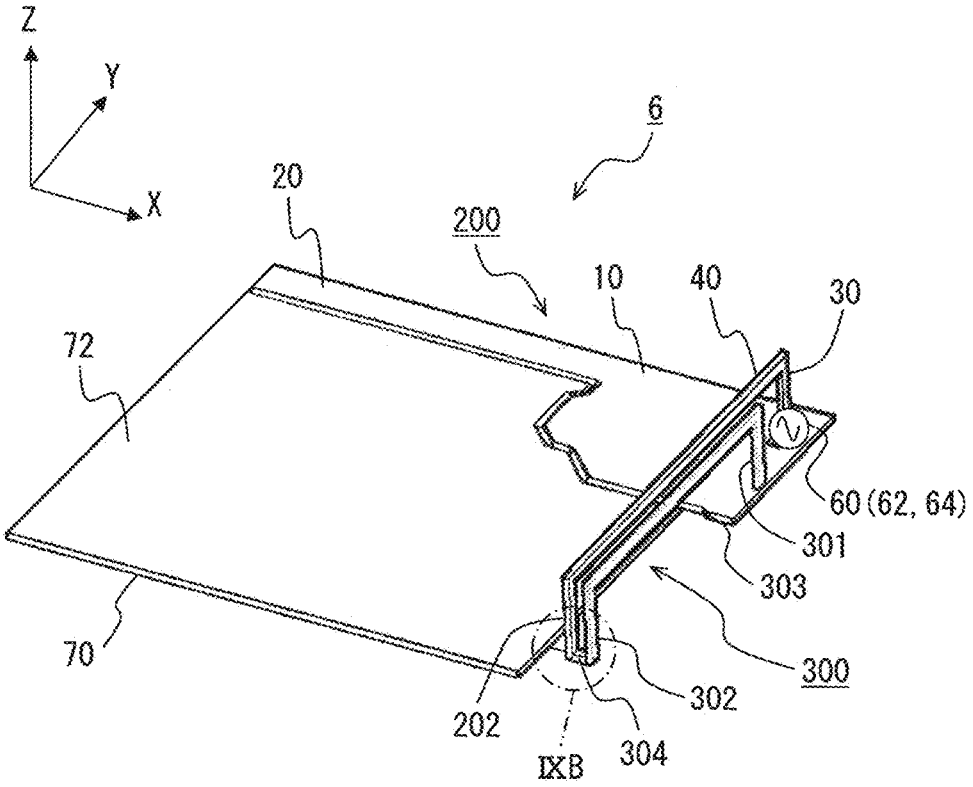
FIG. 9A is a diagram illustrating a simplified structure of an antenna according to a fifth embodiment.

Next, an antenna 6 according to a fifth embodiment is described below with reference to FIGS. 9A and 9B, and FIGS. 10A and 10B. As shown in FIG. 9A, the antenna 6 includes an antenna 200 and a loop antenna 300.

The antenna 200 is an electric field antenna and has an element 202 at a tip of the fourth element 40 of the antenna 1 of the first embodiment. The element 202 has a length up to the board 70 and extends parallel to the first element 30, i.e., in a direction perpendicular to the first element 10.

As shown in FIG. 9A, the loop antenna 300 has a gate shape (rectangular U shape) and includes two elements 301 and 302 provided in a direction perpendicular to the board 70 and an element 303 which connects upper ends of the element 301 and the element 302.

Figure 9B:
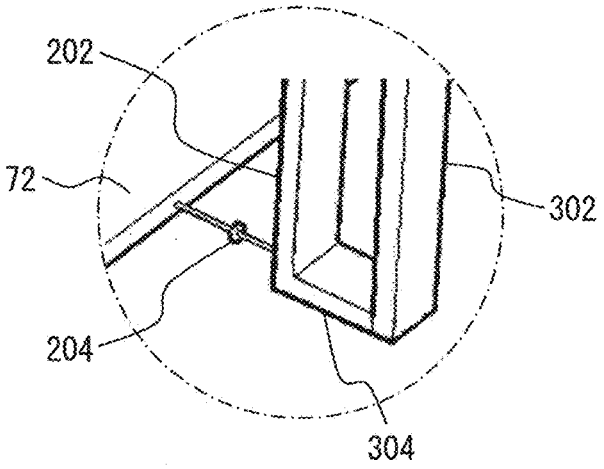
FIG. 9B is a diagram illustrating an enlarged view of a portion IXB in FIG. 9A.

As shown in FIG. 9B which is an enlarged view of a portion (land 304) of the antenna 6, the antenna 200 is electrically connected to the GND 72 of the board 70 through a capacitor (capacitor 204 in FIG. 9B) at an end of the GND 72.

A lower end of the element 301 is located on and electrically short-circuited to the first element 10. A lower end of the element 302 is connected to the element 202 of the antenna 200 through the land 304 made of an electrically conductive material.

(Features of Antenna 6)

Figure 10A:
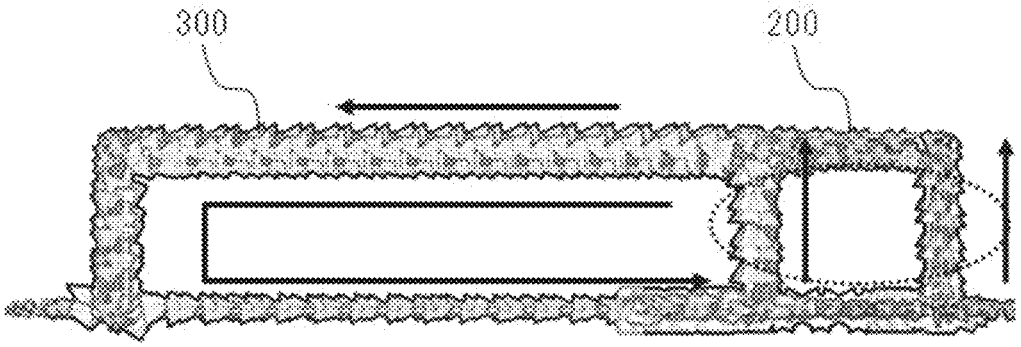
FIG. 10A is a diagram illustrating characteristics of the antenna according to the fifth embodiment.

FIG. 10A shows a current vector of the antenna 6 having the above structure observed at a frequency of 312 [MHz]. As shown in FIG. 10A, there is a large current distribution in the loop antenna 300 as a magnetic field antenna, i.e., the loop antenna 300 resonates.

Figure 10B:
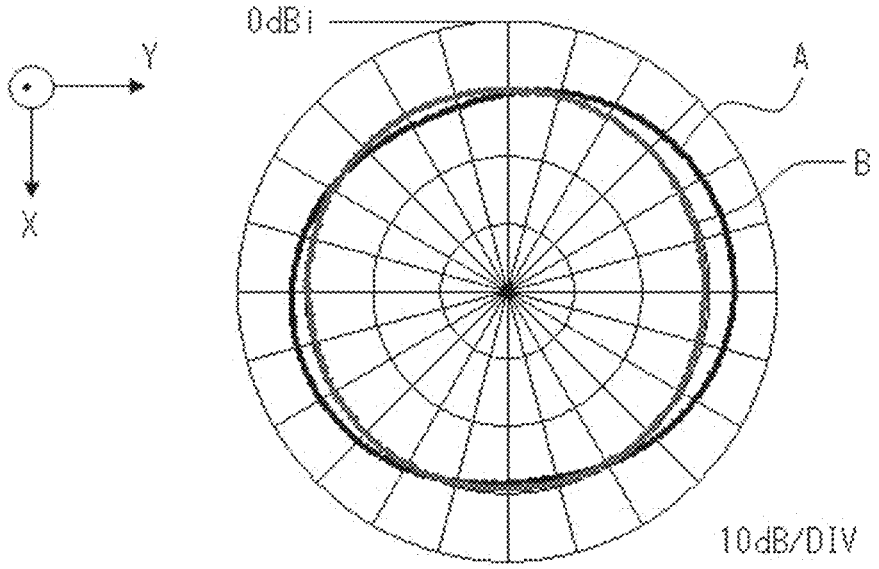
FIG. 10B is a diagram illustrating the characteristics of the antenna according to the fifth embodiment.

FIG. 10B shows directivities of the antenna 1 and the antenna 6 at a frequency of 433 [MHz]. In FIG. 10B, a light solid line (indicated by "B" in FIG. 10B) represents the directivity of the antenna 1, and a dark solid line (indicated by "A" in FIG. 10B) represents the directivity of the antenna 6. As shown in FIG. 10B, the directivity of the antenna 6 is improved compared to that of the antennal 1.

Further, whereas an all-around average gain of the antenna 1 is −10.5 [dBi], an all-around average gain of the antenna 6 is −8.9 [dBi]. This also indicates that transmitting and receiving characteristics of the antenna 6 are improved compared to those of the antenna 1.

Figure 11:
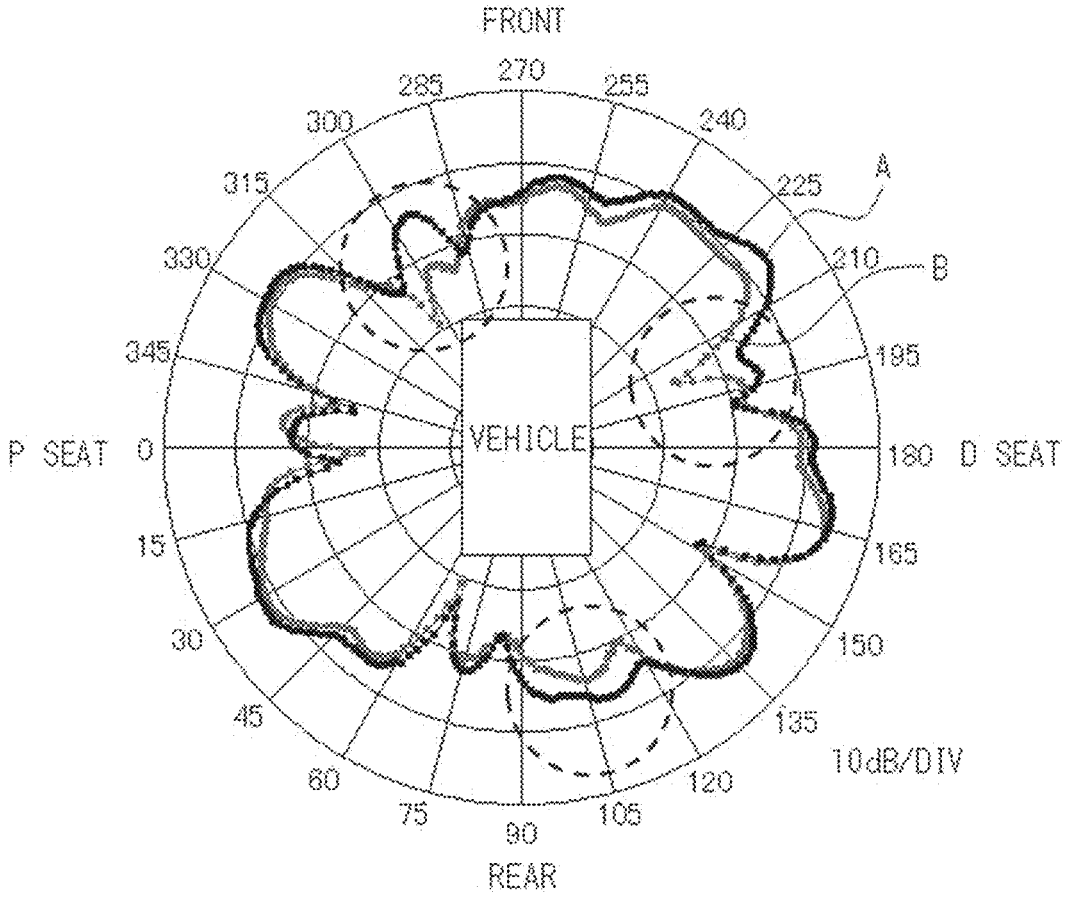
FIG. 11 is a diagram illustrating the characteristics of the antenna according to the fifth embodiment observed when being mounted on a vehicle.

FIG. 11 shows characteristics of induced electromotive force of the antenna when the antenna 6 is mounted on the vehicle. In FIG. 11, a dark solid line (indicated by "A" in FIG. 11) represents characteristics of the antenna 6, and a light solid line (indicated by "B" in FIG. 11) represents characteristics of the antenna 1 (electric field antenna). As indicated by a portion enclosed with a broken line circle in FIG. 11, a Null point is improved in three places.

(Other Embodiments)

Figure 12A:
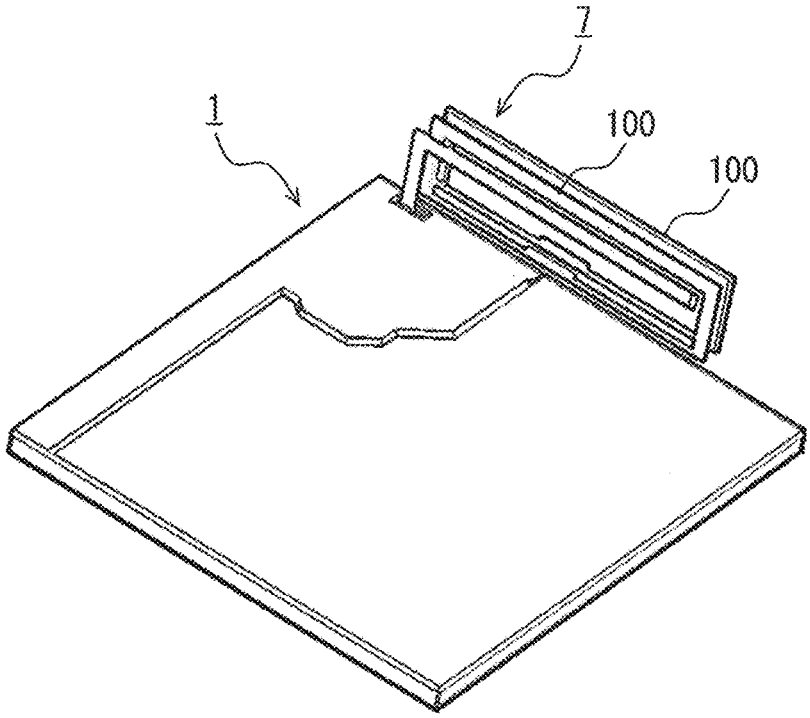
FIG. 12A is a diagram illustrating a simplified structure of an antenna according to another embodiment.
Figure 12B:
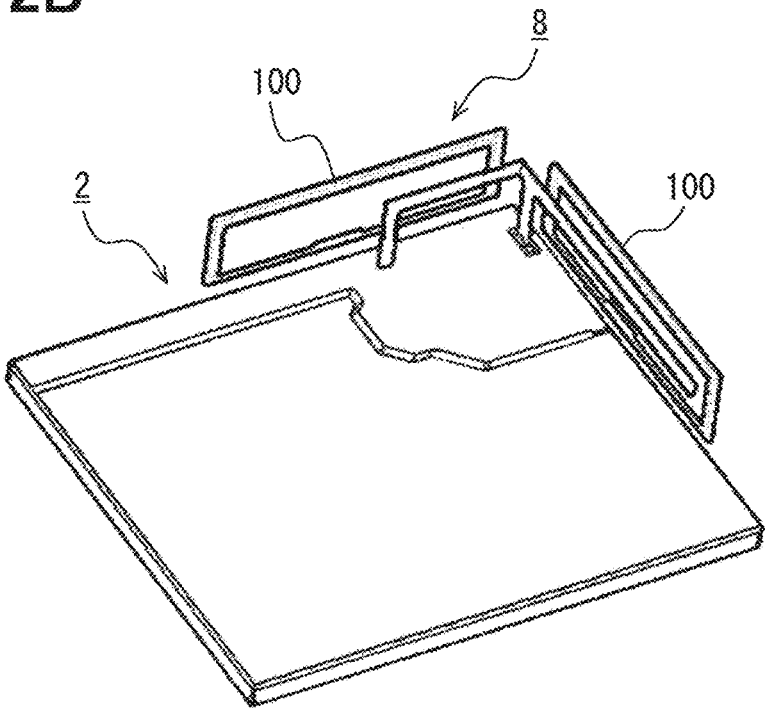
FIG. 12B is a diagram illustrating a simplified structure of an antenna according to another embodiment.

FIG. 12A shows an antenna 7 in which multiple (two in FIG. 12A) loop antennas 100 are aligned to overlap, where each loop antenna 100 is the same as that of the antenna 4 of the third embedment. FIG. 12B shows an antenna 8 in which one loop antenna 100 is placed close to and parallel to each of the fourth element 40 and the fifth element 50 of the antenna 2 of the second embodiment.

Figure 13A:
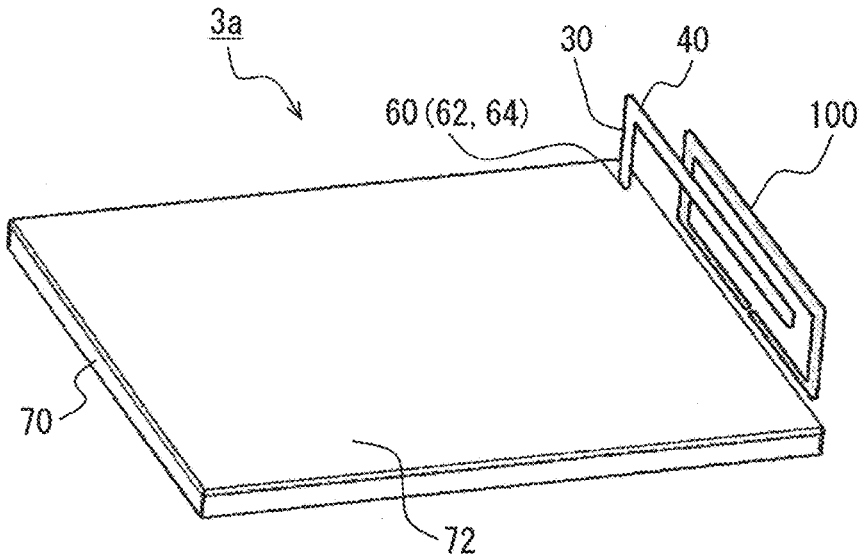
FIG. 13A is a diagram illustrating a simplified structure of an antenna according to another embodiment.

FIG. 13A shows an antenna 3*a* as a monopole electric field antenna formed by integrating the first element 10, the second element 20, and the board GND of the antenna 1 of the antenna 3 of the third embodiment.

Even in the antenna 3*a* like this, the loop antenna 100, serving as not only a monopole electric field antenna but also a magnetic field antenna, achieves an antenna resistant to noise and having a good directivity.

Figure 13B:
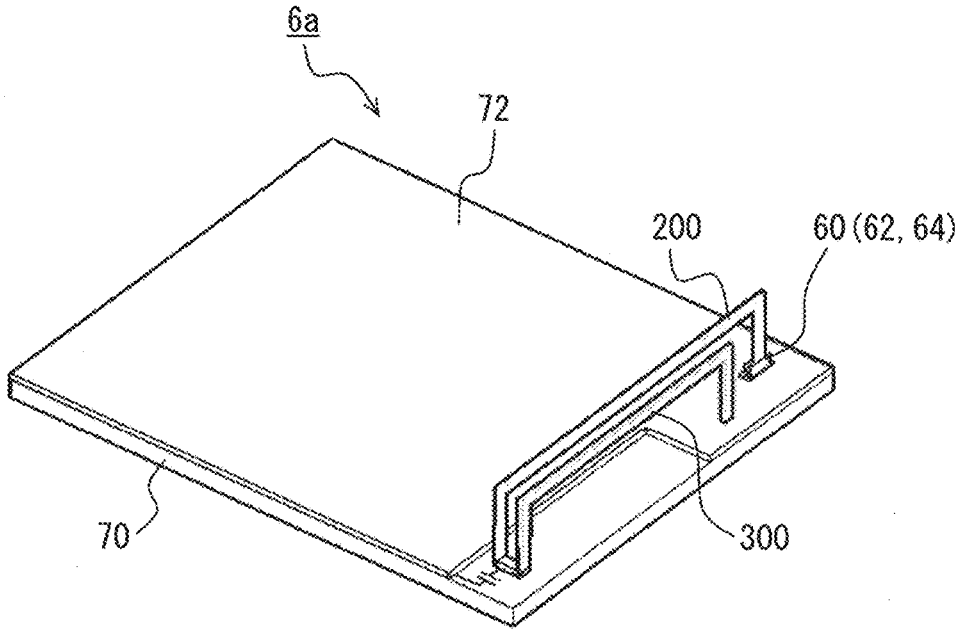
FIG. 13B is a diagram illustrating a simplified structure of an antenna according to another embodiment.

FIG. 13B shows an antenna 6*a* as an electric field antenna formed by integrating the first element 10, the second element 20, and the board GND of the antenna 200 of the antenna 6 of the fifth embodiment.

Even in the antenna 6*a* like this, the loop antenna 100, serving as not only a monopole electric field antenna but also a magnetic field antenna, achieves an antenna resistant to noise and having a good directivity.

What is claimed is:

1. An antenna comprising:

a feeder including a feeder ground and a power source connected to the feeder ground;

a first element connected to the feeder ground and having a predetermined area, the first element being on the same plane as a circuit ground of a wireless circuit and electrically isolated from the circuit ground;

a second element having a first end connected to the first element and a second end as an open end, the second element being on the same plane as the circuit ground and having a predetermined electrical length;

a third element having a first end connected to the power source of the feeder, the third element located in a region occupied by the first element and substantially perpendicular to the first element in such a manner that the first end connected to the power source faces down, the third element having a predetermined height, and a fourth element having a first end connected to a second end of the third element and a second end as an open end, the fourth element being substantially parallel to the first element and substantially perpendicular to a line connecting the first end of the second element connected to the first element to the second end of the second element; wherein the area of the first element is equal to or greater than an area of a circle whose radius is equal to the height of the third element; and a sum of the electrical lengths of the second element, the third element, and the fourth element is equal to ½ of a wavelength of a radio wave to be transmitted and received.

2. The antenna according to claim 1, further comprising:

a fifth element having a first end connected to the fourth element and a second end connected through a capacitor to the first element.

3. The antenna according to claim 2, wherein the capacitor is a variable capacitor.

4. The antenna according to claim 1, further comprising:

a parasitic loop antenna located close to and facing a side of at least one of the first to fourth elements to form a loop through a capacitor, the parasitic loop antenna being electrically isolated from the circuit ground and the first to fourth elements.

5. The antenna according to claim 1, wherein the first element has a width in a direction along the second element, the first element has a length in a direction along the fourth element, and each of the width and the length of the first element is equal to or greater than the height of the third element.

6. The antenna according to claim 1, wherein the first element, the second element, the third element and the power source form a dipole structure.

7. The antenna according to claim 6, wherein the first element, the third element, the power source and the feeder ground form a monopole structure.

8. The antenna according to claim 7, wherein the first element and the third element form an electric field perpendicular to the third element.

9. The antenna according to claim 1, wherein the first element, the third element, the power source and the feeder ground form a monopole structure.

10. The antenna according to claim 1, wherein the first element and the third element form an electric field perpendicular to the third element.

* * * * *